US011446583B2

(12) United States Patent
Han et al.

(10) Patent No.: US 11,446,583 B2
(45) Date of Patent: Sep. 20, 2022

(54) TOY VEHICLE TRACK SET

(71) Applicant: Mattel, Inc., El Segundo, CA (US)

(72) Inventors: Eric Han, Los Angeles, CA (US); Tsz Kin Lim, Hong Kong (CN)

(73) Assignee: Mattel, Inc., El Segundo, CA (US)

( * ) Notice: Subject to any disclaimer, the term of this patent is extended or adjusted under 35 U.S.C. 154(b) by 479 days.

(21) Appl. No.: 16/720,594

(22) Filed: Dec. 19, 2019

(65) Prior Publication Data

US 2020/0206642 A1 Jul. 2, 2020

Related U.S. Application Data

(60) Provisional application No. 62/785,084, filed on Dec. 26, 2018.

(51) Int. Cl.
*A63H 18/02* (2006.01)

(52) U.S. Cl.
CPC ..... *A63H 18/021* (2013.01); *A63H 18/028* (2013.01)

(58) Field of Classification Search
CPC ..... A63H 18/00; A63H 18/02; A63H 18/04; A63H 18/06; A63H 18/021; A63H 18/028
USPC ..... 238/10 F; 446/170, 173, 174
See application file for complete search history.

(56) References Cited

U.S. PATENT DOCUMENTS 3,697,075 A 10/1972 Nania
3,712,539 A 1/1973 Staats
4,355,807 A 10/1982 Prehodka
4,449,665 A 5/1984 Goldfarb et al.
5,813,351 A 9/1998 Chen
6,601,774 B1 * 8/2003 Kasimoff ..... A63H 18/02 238/10 R
7,628,674 B2 12/2009 Nuttall et al.
7,857,679 B2 12/2010 O'Connor et al.
7,892,068 B2 2/2011 Nuttall et al.
7,934,970 B2 * 5/2011 O'Connor ..... A63H 18/02 446/6
8,006,943 B2 8/2011 O'Connor
8,221,184 B2 7/2012 Nuttall et al.
8,251,768 B2 8/2012 Nuttall
8,256,721 B2 9/2012 O'Connor et al.
8,298,038 B2 10/2012 O'Connor et al.
8,322,660 B2 12/2012 O'Connor
8,382,553 B2 2/2013 O'Connor
8,430,712 B2 4/2013 O'Connor et al.
8,449,344 B2 5/2013 Nuttall et al.
(Continued)

*Primary Examiner* — Joseph B Baldori
(74) *Attorney, Agent, or Firm* — MLO, a professional corp.

(57) ABSTRACT

A toy vehicle track set includes a base having a first pivotable end and a second pivotable end. A first segment is coupled to the first pivotable end. A first connector has a first hinge, a first tongue and a second tongue. A second segment is hingedly coupled to the first segment by the first connector. A third segment is coupled to the second pivotable end. A second connector has a second hinge, a third tongue and a fourth tongue. A fourth segment is hingedly coupled to the third segment by the second connector. The first and second tongue of the first connector are configured to slidably couple to the first and second segments, respectively, and rotate relative to the first hinge. The third and fourth tongue of the second connector are configured to slidably couple to the third and fourth segments, respectively, and rotate relative to the second hinge.

20 Claims, 15 Drawing Sheets

(56) References Cited

U.S. PATENT DOCUMENTS

| | | | | |
|---|---|---|---|---|
| 8,500,510 | B2 | 8/2013 | Nuttall et al. | |
| 8,668,081 | B2 | 3/2014 | Hippely et al. | |
| 8,690,632 | B2 | 4/2014 | O'Connor et al. | |
| 8,747,180 | B2 | 6/2014 | O'Connor et al. | |
| 8,801,492 | B2 | 8/2014 | O'Connor et al. | |
| 8,876,573 | B2 | 11/2014 | O'Connor et al. | |
| 8,992,282 | B2 | 3/2015 | Desent et al. | |
| 9,199,179 | B2 * | 12/2015 | O'Connor | A63H 18/02 |
| 9,314,704 | B2 * | 4/2016 | Ostendorff | A63H 18/025 |
| 9,345,980 | B2 | 5/2016 | Lee | |
| 9,504,926 | B2 | 11/2016 | O'Connor et al. | |
| 9,573,071 | B2 | 2/2017 | Yu et al. | |
| 9,682,328 | B2 | 6/2017 | Yang et al. | |
| 9,925,472 | B2 | 3/2018 | Yang et al. | |
| 10,518,185 | B1 * | 12/2019 | Welby | A63H 18/00 |
| 10,653,972 | B2 * | 5/2020 | Welby | A63H 18/028 |
| 2005/0287918 | A1 | 12/2005 | Sheltman et al. | |
| 2007/0049160 | A1 | 3/2007 | Matthes et al. | |
| 2008/0051001 | A1 | 2/2008 | Nuttall et al. | |
| 2010/0081356 | A1 | 4/2010 | Lutchen et al. | |
| 2012/0178336 | A1 | 7/2012 | Nuttall et al. | |
| 2012/0324708 | A1 | 12/2012 | Minin | |
| 2013/0295818 | A1 | 11/2013 | O'Connor et al. | |
| 2014/0084074 | A1 | 3/2014 | O'Connor et al. | |
| 2016/0067621 | A1 | 3/2016 | Moreno et al. | |
| 2017/0106303 | A1 | 4/2017 | O'Connor et al. | |
| 2020/0206642 | A1 * | 7/2020 | Han | A63H 18/02 |

* cited by examiner

TOY VEHICLE TRACK SET

CROSS REFERENCE TO RELATED APPLICATIONS

This application claims priority to U.S. Provisional Patent Application No. 62/785,084 filed Dec. 26, 2018, which is hereby incorporated by reference in full.

BACKGROUND

Toy vehicle track sets have long been a source of entertainment for children and can be configured and used for creative play. Some sets may be large and expansive requiring a significant amount of storage space when not in use. A collapsible toy vehicle track set that folds into a smaller configuration without requiring reassembly, reorganizing and/or handling of separate parts provides enhanced convenience and play value.

SUMMARY

A collapsible toy vehicle track set that folds into a more compact configuration is described herein. In one or more embodiments, the toy vehicle track set includes a base having a first pivotable end and a second pivotable end opposite the first pivotable end. A first track segment is coupled to the first pivotable end and a second track segment is hingedly coupled to the first track segment by a first connector. The first connector has a first hinge, a first tongue, and a second tongue opposite the first tongue. The first tongue and the second tongue of the first connector are configured to slidably couple to the first and second track segments, respectively, and rotate relative to the first hinge. A third track segment is coupled to the second pivotable end and a fourth track segment is hingedly coupled to the third track segment by a second connector. The second connector has a second hinge, a third tongue, and a fourth tongue opposite the third tongue. The third tongue and the fourth tongue of the second connector are configured to slidably couple to the third and fourth track segments, respectively, and rotate relative to the second hinge.

In some embodiments, the toy vehicle track set includes a first toy vehicle raceway and a second toy vehicle raceway coupled together side-by-side. Each raceway includes a base having a first end, a second end opposite the first end, and a loop track segment between the first end and the second end. A first foldable track is pivotably coupled to the first end of the base. A second foldable track is pivotably coupled to the second end of the base. For each of the first and second toy vehicle raceways, a projection is on one side of the raceway and a socket is on an opposite side of the raceway. Each of the first and second foldable tracks comprises a connector, a first track segment, and a second track segment hingedly coupled to the first track segment with the connector. The raceways are coupled together by engaging the projection of one raceway with the socket of the other raceway such that the raceways are positioned adjacent to each other.

In some embodiments, the toy vehicle track set includes a base having a first pivotable end with a first tab and a second pivotable end with a second tab. The second pivotable end is opposite the first pivotable end. A first foldable track is slidably coupled to the first tab of the first pivotable end. The first foldable track has a first track segment and a second track segment. A second foldable track is slidably coupled to the second tab of the second pivotable end. The second foldable track has a third track segment and a fourth track segment. A first connector has a first hinge, a first tongue and a second tongue opposite the first tongue. The first tongue and the second tongue are configured to slidably couple to the first and second track segments, respectively, and rotate relative to the first hinge. A second connector has a second hinge, a third tongue and a fourth tongue. The third tongue and the fourth tongue are configured to slidably couple to the third and fourth track segments, respectively, and rotate relative to the second hinge. A projection is on one side of the toy vehicle track set and a socket is on an opposite side of the toy vehicle track set. Two toy vehicle track sets are coupled together by engaging the projection of one toy vehicle track set with the socket of the other toy vehicle track set such that the toy vehicle track sets are positioned adjacent to each other.

DETAILED DESCRIPTION

A toy vehicle track set is disclosed herein which may be used in conjunction with a toy vehicle. The toy vehicle track set can be quickly and easily set up for play or folded into a much smaller footprint for storage without having to spend time or energy on assembling, organizing or handling separate components. In some embodiments, the toy vehicle track set is folded and stored with one or more raceways coupled together, and with one or more track segments as desired by the user. A plurality of track segments are typically included in the toy vehicle track set. One end of a track segment is hingedly coupled to the base, which allows the track segment to be able to pivot/rotate upwards relative to the base. The other end of the track segment is hingedly coupled to a connector. A hinge in the connector enables the track segment to be pivoted/rotated downwards relative to the connector. Utilizing the hinged connections of the base and connector, the toy vehicle track set can be folded into a smaller toy for storage and transport purposes.

Figure 1:
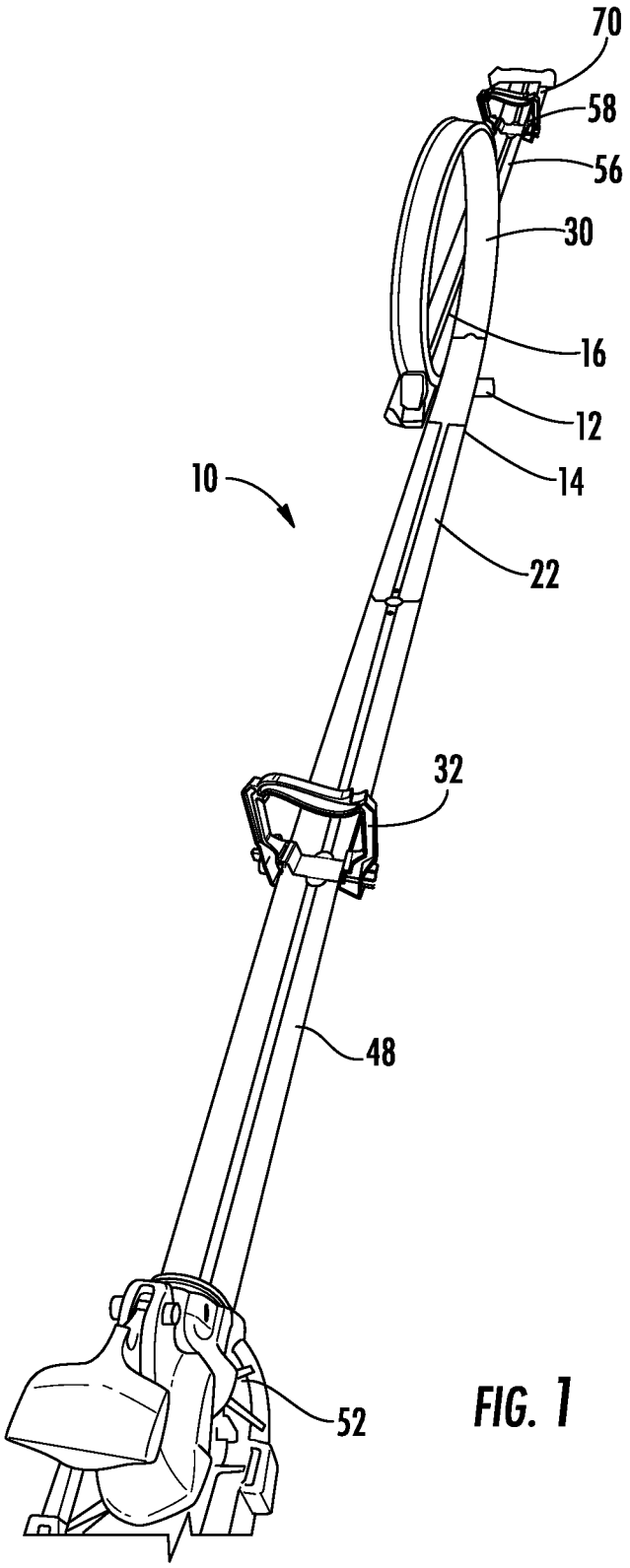
FIG. 1 is a perspective view of a toy vehicle track set, in accordance with some embodiments.
Figure 2:
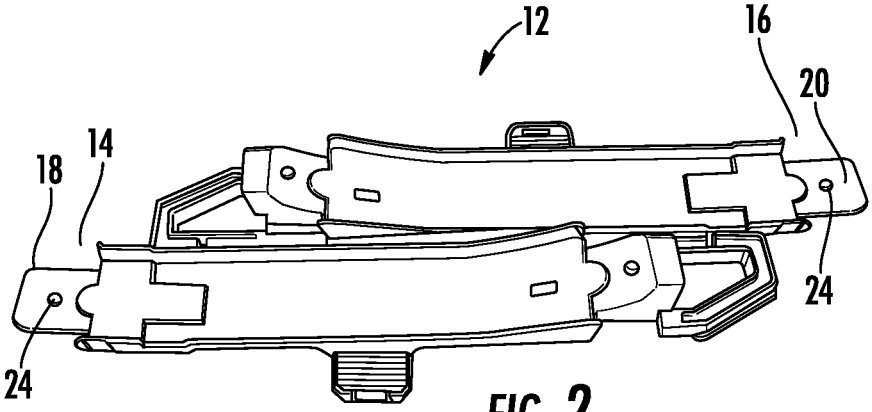
FIG. 2 is a perspective view of a base of the toy vehicle track set, in accordance with some embodiments.

Referring now to the figures, FIG. 1 is a perspective view of a toy vehicle track set, in accordance with some embodiments. In the illustrative embodiment shown in FIG. 1, the toy vehicle track set 10 a single toy vehicle raceway that can be used in conjunction with toy vehicles. In an unfolded play mode or expanded configuration, the toy vehicle track set provides a continuous path where a toy vehicle travels along a plurality of track segments and, in certain instances, a loop track segment. The toy vehicle track set 10 includes a base 12. FIG. 2 is a perspective view of the base 12 of the toy vehicle track set 10, in accordance with some embodiments. The base 12 has a first pivotable end 14 and a second pivotable end 16 opposite the first pivotable end 14. The first pivotable end 14 has a first tab 18, and the second pivotable end 16 has a second tab 20. The first pivotable end 14 and the second pivotable end 16 are configured to rotate upward relative to the base 12.

Figure 3:
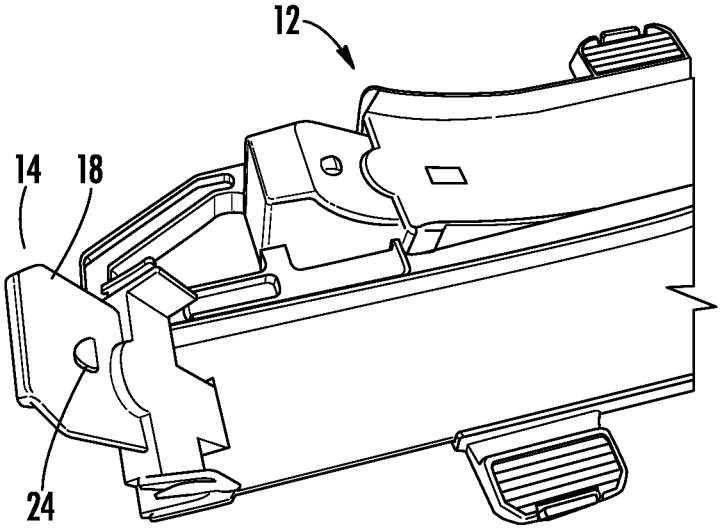
FIG. 3 is a perspective view of the base of the toy vehicle track set with the first pivotable end in the upward position, in accordance with some embodiments.

FIG. 3 is a perspective view of the base 12 of the toy vehicle track set 10 with the first pivotable end 14 in an upward position, in accordance with some embodiments. A track segment may be coupled to the first pivotable end 14 via the first tab 18 or to the second pivotable end 16 via the second tab 20. For example as shown in FIG. 1, a first track segment 22 is slidably coupled to the first tab 18 to construct the toy vehicle track set 10. This slidable coupling with a tab makes assembly, reassembly and/or disassembly of the track segments, easy for a child, but still secure enough that the track segments do not unintentionally detach when collapsing the toy vehicle track set 10 into a compact configuration for storage.

Figure 4:
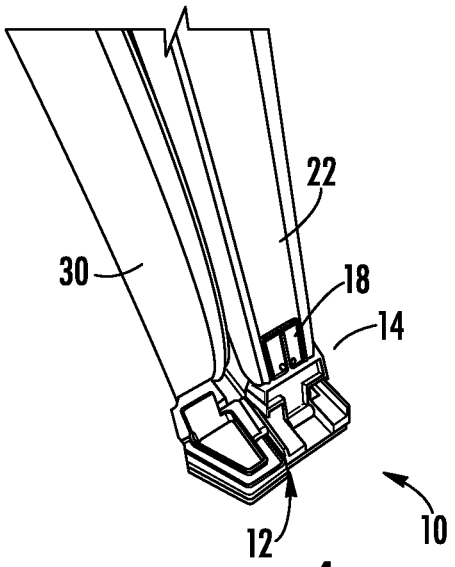
FIG. 4 is a perspective view of the toy vehicle track set, in accordance with some embodiments.
Figure 5:
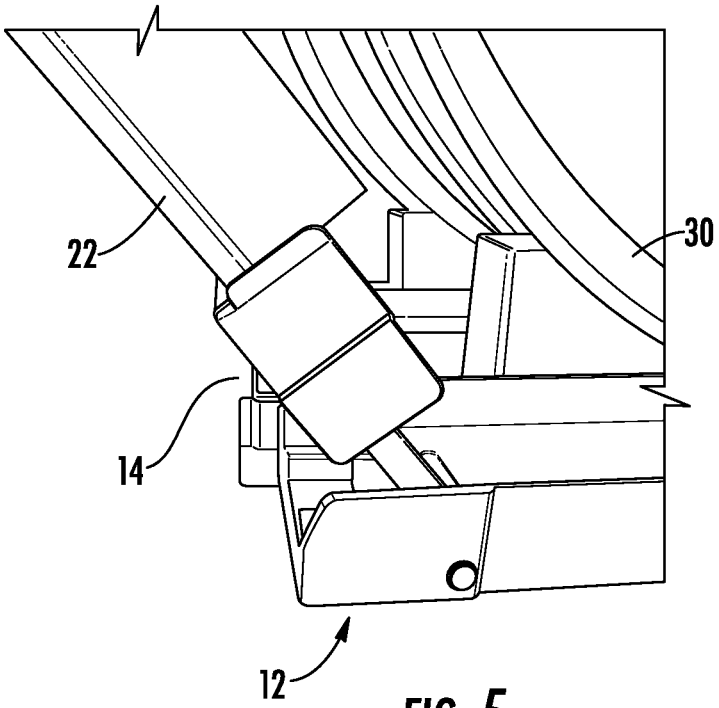
FIG. 5 is a side view of the base of the toy vehicle track set with the first pivotable end in an upward pivoted position, in accordance with some embodiments.

FIG. 4 is a perspective view of the toy vehicle track set 10, in accordance with some embodiments. The first tab 18 of the first pivotable end 14 is slidably coupled to the first track segment 22. The first track segment 22 is configured to receive the first tab 18 by, for example, having a groove on both edges of the underside of the first track segment 22 that guides the first tab 18 into the first track segment 22. For example, the first pivotable end 14 comprises the first tab 18 configured to slidably couple to the first track segment 22 by engaging with an underside of the first track segment 22. This enables the first track segment 22 to be pivoted, such as pivoting a few degrees upwards to a substantially perpendicular position relative to the base 12. A plurality of track segments are interchangeable with the first track segment 22 with the first tab 18 slidably coupling to any of the plurality of track segments in the same way. In other embodiments, the first tab 18 is coupled to the first track segment 22 by other means such as a snap fit, hook and loop fasteners, mechanical fasteners, magnets or the like. FIG. 5 is a side view of the base 12 of the toy vehicle track set 10 with the first pivotable end 14 in an upward pivoted position, in accordance with some embodiments.

Figure 6:
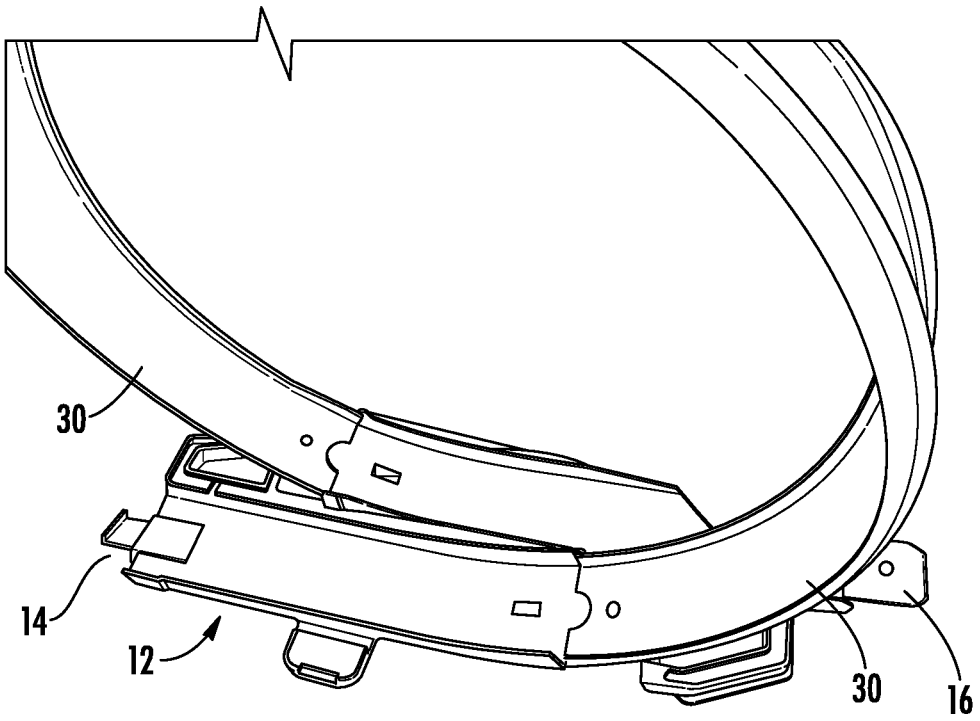
FIG. 6 is a perspective view of a loop track segment of the toy vehicle track set, in accordance with some embodiments.

In some embodiments, the toy vehicle track set 10 includes a loop track segment 30 attached to and located between the first pivotable end 14 and the second pivotable end 16 of the base 12. FIG. 6 is a perspective view of the loop track segment 30 of the toy vehicle track set 10, in accordance with some embodiments. The loop track segment 30 adds variety and excitement to the play.

Figure 7:
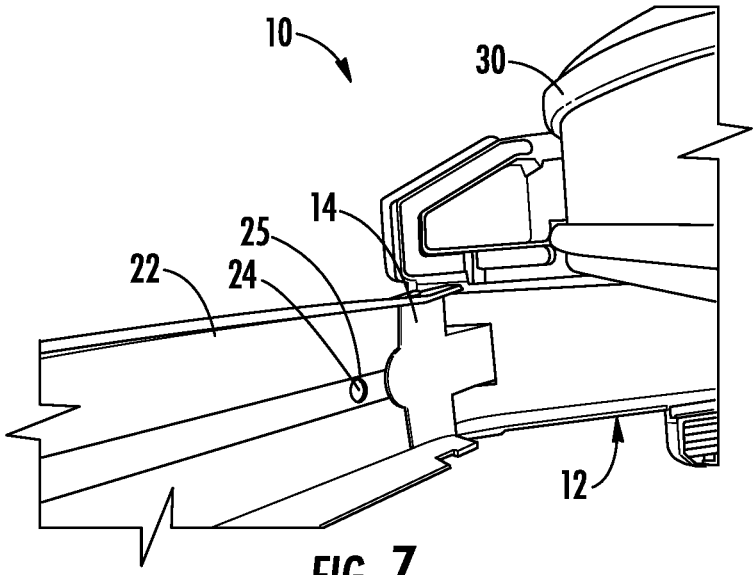
FIG. 7 is a top view of the toy vehicle track set, in accordance with some embodiments.

In one or more embodiments, the first tab 18 and the second tab 20 includes buttons 24, as shown in FIGS. 2 and 3. FIG. 7 is a top side view of the toy vehicle track set 10 showing the button 24 with the first track segment 22 attached. The button 24 of the first tab 18 is configured to be received by an aperture 25 (refer to FIG. 14) in the first track segment 22. The button 24 is used to locate and confirm a secure connection between the first tab 18 of the first pivotable end 14 and the first track segment 22. The mating of the button 24 and the aperture 25 aid in the assembling of the toy vehicle track set 10 while keeping the connections between the track segments and base secure, especially when the toy vehicle track set 10 is being folded for storage.

Figure 8:
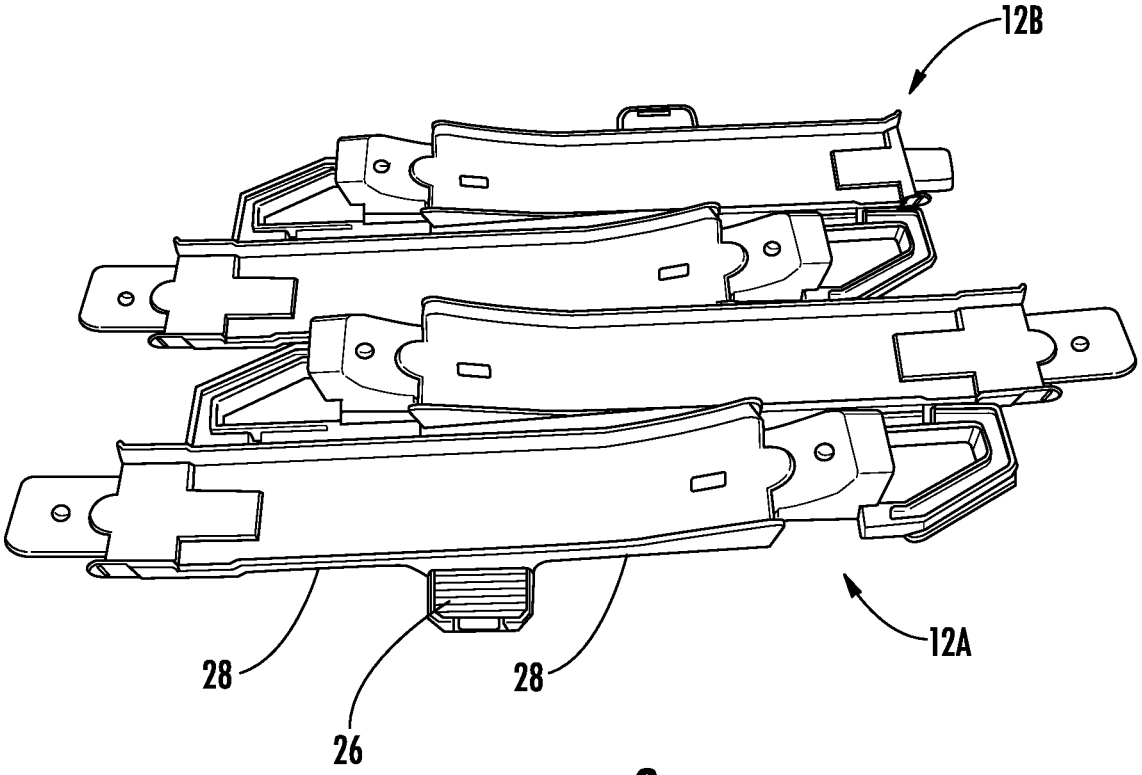
FIG. 8 is a perspective view of a base coupled to a neighboring base, in accordance with some embodiments.
Figure 9:
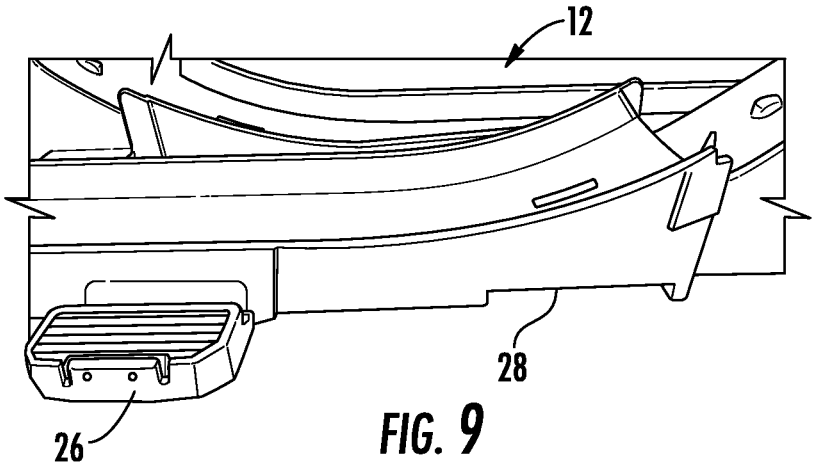
FIG. 9 is a close-up view of a joiner and a slot of the base, in accordance with some embodiments.

In one or more embodiments, the base 12 may be coupled to additional bases. FIG. 8 is a perspective view of a base 12A coupled to a neighboring base 12B, in accordance with some embodiments. Base 12A and 12B each have a joiner 26 (e.g., a tab or other protrusion) and a plurality of slots 28. The joiner 26 of base 12A is coupled to one of the slots 28 of the neighboring base 12B. In the exemplary implementation shown in FIG. 8, the joiner 26 is inserted into the slot 28 with a press fit so that the bases 12A and 12B are coupled in a side-to-side or adjacent fashion. In other implementations, the base 12A is coupled to the neighboring base 12B by snap fit, hook and loop fasteners, mechanical fasteners, magnets or the like. FIG. 9 is a close-up view of the joiner 26 and one slot 28 of the base 12, in accordance with some embodiments.

Figure 10:
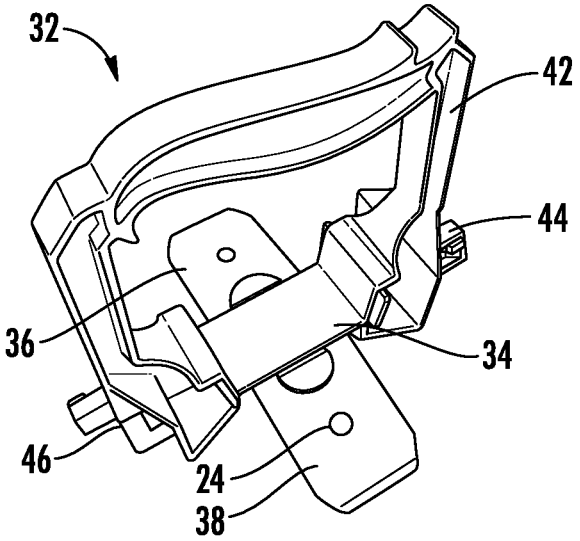
FIG. 10 is a perspective view of a first connector, in accordance with some embodiments.
Figure 11:
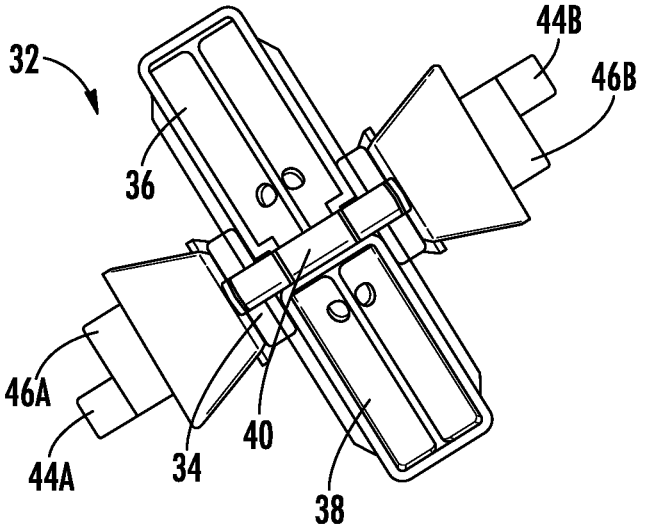
FIG. 11 is a bottom view of the first connector, in accordance with some embodiments.
Figure 12:
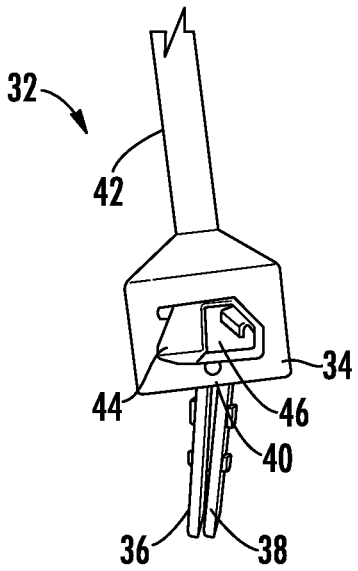
FIG. 12 is a side view of the first connector, in accordance with some embodiments.

In one or more embodiments, the toy vehicle track set includes a connector that connects two track segments together. FIG. 10 provides a perspective view of a first connector 32, FIG. 11 is a bottom view of the first connector 32, and FIG. 12 is a side view of the first connector 32. The first connector 32 has a first support 34, a first tongue 36, a second tongue 38 opposite the first tongue 36, and a first hinge 40 (shown in FIG. 11). In some embodiments, the first connector 32 includes a first bracket 42. The first bracket 42 extends upward from the first support 34 and serves as a handle. The first bracket 42 may be of any shape that allows the hand of the user to easily grab and lift upwards.

In some embodiments (for example as shown in FIG. 10), the first connector 32 includes a projection 44 located on a first side of the first connector 32 and a socket 46 located on a second side of the first connector 32 opposite the projection 44. Referring to FIG. 11, in other embodiments, the first connector 32 includes a first projection 44A and a first socket 46A located on a first side of the first connector 32, and a second projection 44B and a second socket 46B located on a second side of the first connector 32 opposite the projection 44A and socket 46A. In both embodiments, the projection 44 of the first connector 32 of one toy vehicle track set 10 or raceway is configured to engage with the socket 46 of the first connector 32 of an adjacent toy vehicle track set 10 or raceway which enables two toy vehicle track sets 10 or raceways to be coupled together side-by-side.

Figure 13:
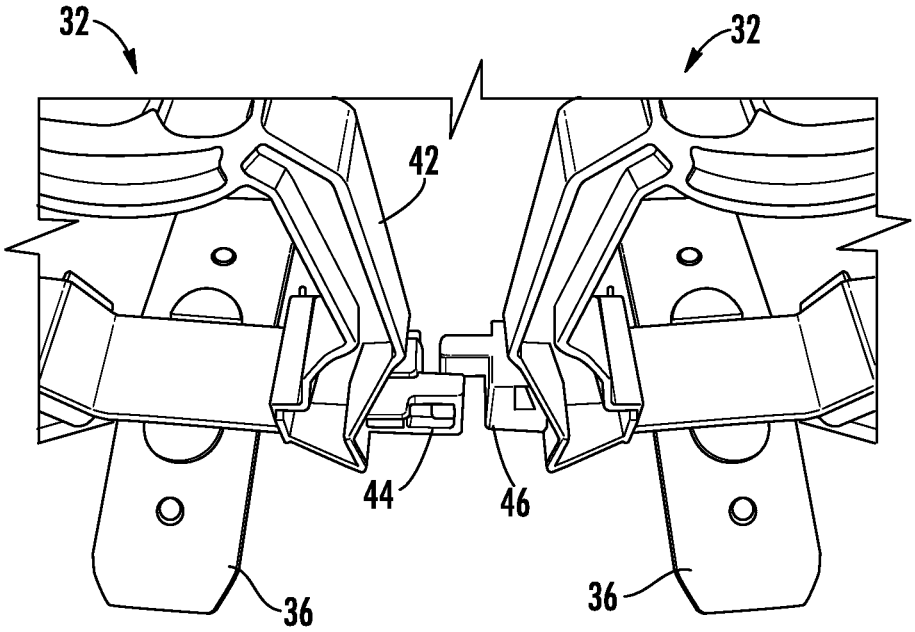
FIG. 13 is a view of two adjacent first connectors, in accordance with some embodiments.

FIG. 13 is an illustrative view of two adjacent first connectors, in accordance with some embodiments. The projection 44 of the first connector 32 of the toy vehicle track set 10 is aligned with the socket 46 of an adjacent first connector 32 of a neighboring toy vehicle track set 10 such that the two first connectors 32 can be coupled together. In other embodiments, adjacent toy vehicle track sets 10 are coupled together in a side-by-side configuration by other means such as a snap fit, hook and loop fasteners, mechanical fasteners, magnets or the like. Additional first connectors may be further coupled in a similar manner to the two first connectors 32 shown in FIG. 13 so that the toy vehicle track set comprises more than two raceways.

In one or more embodiments, the first tongue 36 and the second tongue 38 of the first connector 32 are configured to rotate downwards along the first hinge 40. For example, FIG. 12 shows the first tongue 36 and the second tongue 38 of the first connector 32 having rotated downwards (i.e., away from the first bracket 42) approximately 90° relative to the first support 34. In an exemplary implementation, the user lifts the first connector 32 by applying an upward force on the first bracket 42. This allows the first tongue 36 and the second tongue 38 of the first connector to passively rotate/pivot downwards and away from the first support 34 due to gravity (as shown in FIG. 11). In another embodiment, a downward force is applied directly to the first tongue 36 and the second tongue 38 of the first connector to rotate/pivot the first tongue 36 and the second tongue 38 away from the first support 34.

Figure 21:
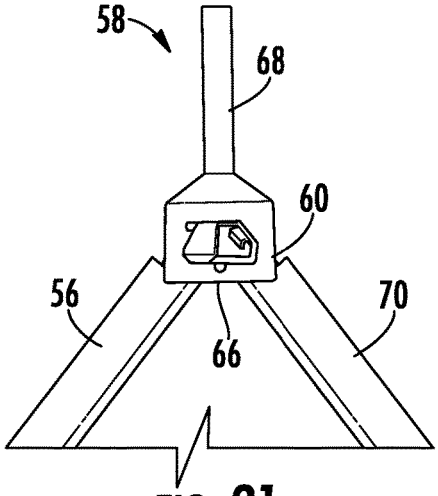
FIG. 21 is a side view of the second connector, in accordance with some embodiments.

In some embodiments, the first tongue 36 and the second tongue 38 are configured to rotate to approximately the same angle at the same time (as shown in FIG. 21). In other embodiments, because the first tongue 36 and the second tongue 38 rotate independently from one another, the first tongue 36 and the second tongue 38 are configured to be rotated to different angles at the same time. For example, the first tongue 36 may be rotated to 90° downwards relative to the first support 34 while the second tongue 38 is rotated to a different angle such as 45°, 60° or 90° downwards relative to the first support 34. In another example, the first tongue 36 cannot be rotated and is rotated 0° relative to the first support 34 while the second tongue 38 is rotated 90° downwards relative to the first support 34.

Figure 14:
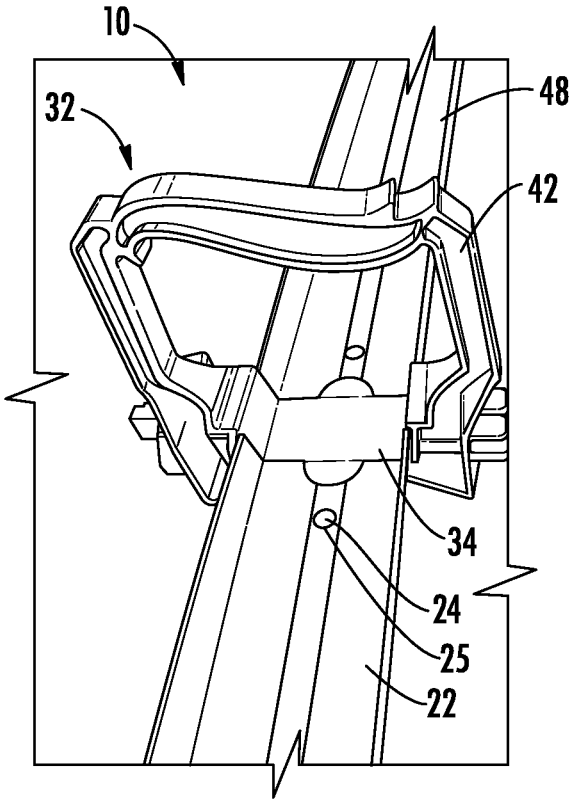
FIG. 14 is a perspective view of a second track segment hingedly coupled to the first track segment by the first connector of the toy vehicle track set, in accordance with some embodiments.
Figure 15:
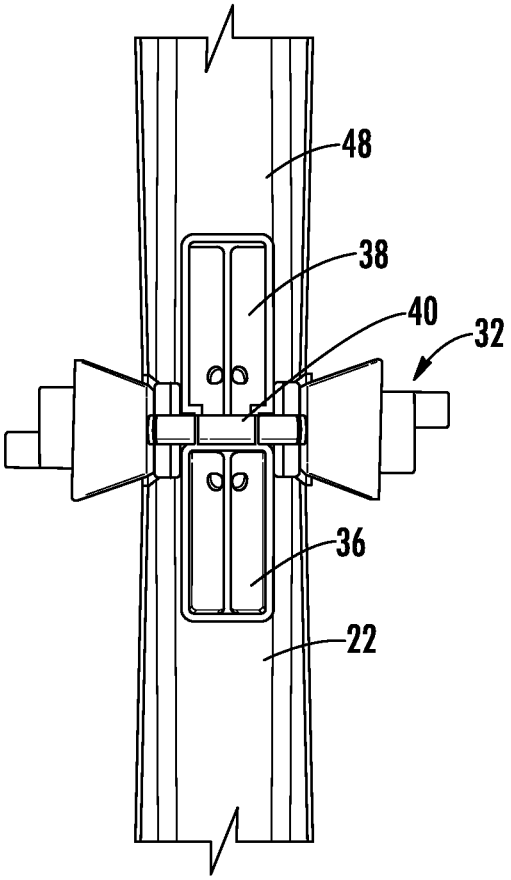
FIG. 15 is a bottom view of the second track segment hingedly coupled to the first track segment by the first connector of the toy vehicle track set, in accordance with some embodiments.
Figure 16A:
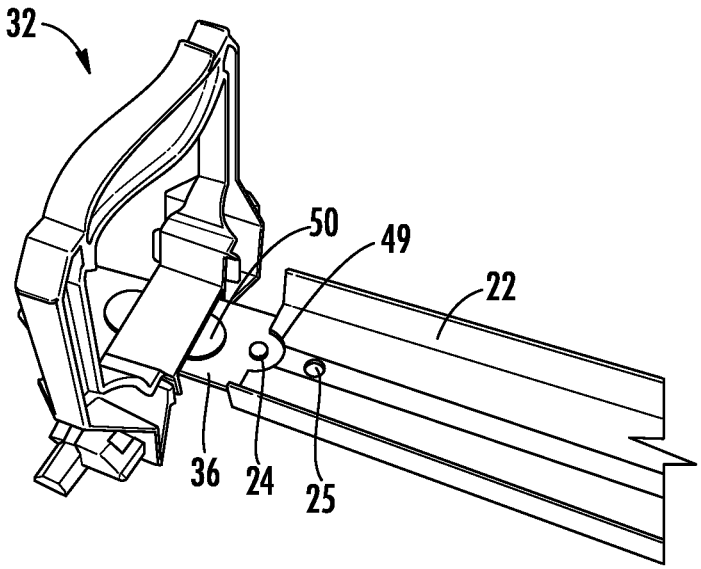
FIGS. 16A and 16B show a first tongue sliding onto the first track segment, in accordance with some embodiments.
Figure 16B:
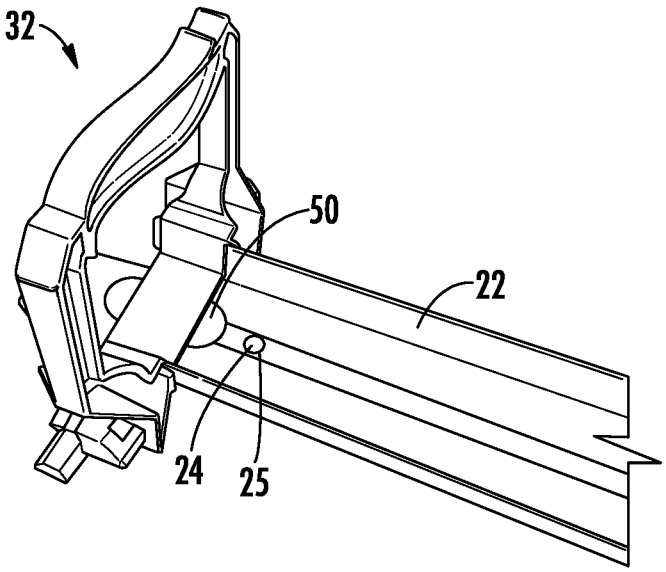

FIG. 14 is a perspective view of a second track segment 48 hingedly coupled to the first track segment 22 by the first connector 32 of the toy vehicle track set 10. FIG. 15 is a bottom view of the second track segment 48 hingedly coupled to the first track segment 22 by the first connector 32 of the toy vehicle track set 10. The first tongue 36 and the second tongue 38 of the first connector 32 are configured to slidably couple to the first track segment 22 and the second track segment 48, respectively. For example, FIGS. 16A and 16B show the first tongue 36 sliding onto the first track segment 22, in accordance with some embodiments. The first track segment 22 has an aperture 25 and a cutout 49. The first tongue 36 slides into the first track segment 22 until the button 24 engages with the aperture 25. In some embodiments, the first tongue 36 includes a lip 50 that helps guide the first tongue 36 onto the first track segment 22 and confirms a proper fit by aligning with the cutout 49 on the first track segment 22.

In one or more embodiments, the toy vehicle track set 10 includes a plurality of connectors similar to the first connector 32. The plurality of connectors operate in the same way as the first connector 32 and are interchangeable with one another. In some embodiments, the plurality of connectors may or may not have a bracket extending from the support. Including additional connectors allows the toy vehicle track set 10 to provide a longer raceway with additional hingedly coupled track segments that can also be similarly folded into a more compact configuration (see, e.g., FIGS. 23 and 24).

Figure 17:
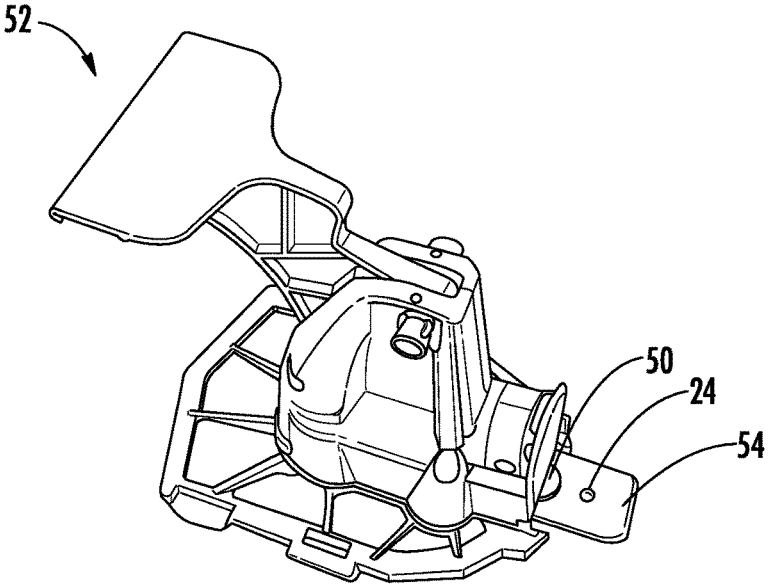
FIG. 17 is a perspective view of a toy vehicle launcher, in accordance with some embodiments.
Figure 18:
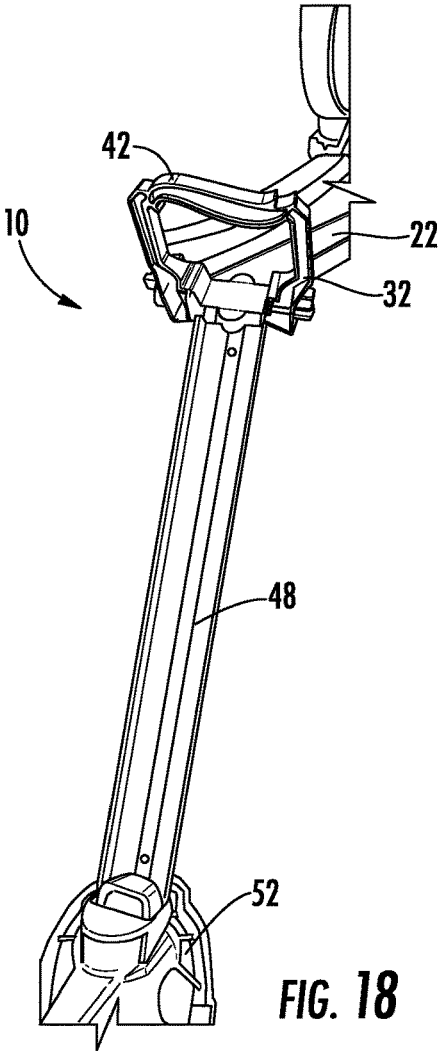
FIG. 18 is a top perspective view of the toy vehicle track set with the toy vehicle launcher, in accordance with some embodiments.

In one or more embodiments, the second track segment 48 is further coupled to an accessory. One example as shown in FIG. 17 is a toy vehicle launcher 52. The toy vehicle launcher 52 is coupled to the second track segment 48 by a strip 54. The strip 54 also has the button 24 and the lip 50 and slidably couples to the second track segment 48 in the manner described herein regarding the first connector 32. The strip 54 may pivot, hinge or be stationary depending on the application. In some embodiments, the accessory is coupled to the second track segment 48 by other means such as a snap fit, hook and loop fasteners, mechanical fasteners, magnets or the like. FIG. 18 depicts the toy vehicle track set 10 with the toy vehicle launcher 52. Other accessories include, for example, a tunnel, ramp, garage, building, and rough track surface. In preferred embodiments, the toy vehicle track set can still be folded into a compact configuration with the accessory attached. The user lifts the first connector 32 by applying an upward force to the first bracket 42. Then, the first tongue 36 and the second tongue 38 of the first connector naturally rotate downward and away from the first support 34 due to gravity and the first hinge 40. The toy vehicle track set 10 is easily collapsed and transformed in this manner.

Figure 19:
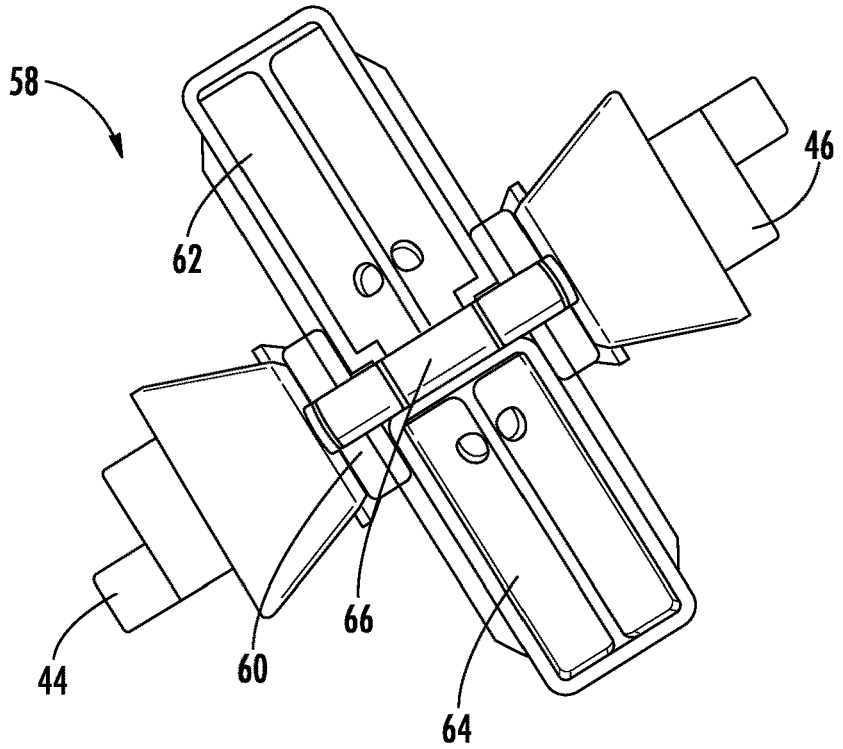
FIG. 19 is a bottom view of a second connector, in accordance with some embodiments.

Referring to FIGS. 1 and 2, a third track segment 56 is coupled to the second pivotable end 16 via the second tab 20 of the base 12. This is achieved in a manner similar to the coupling of the first track segment 22 to the first pivotable end 14 via the first tab 18 of the base 12 as described above (see e.g., FIG. 7). In one exemplary implementation, the second pivotable end 16 comprises a second tab 20 configured to slidably couple to the third track segment 56 by engaging with an underside of the third track segment 56. This enables the third track segment 56 to be pivoted, such as to a position substantially perpendicular to the base 12. Moreover, as shown in FIG. 19, in one or more embodiments, the toy vehicle track set includes a second connector 58 that is identical to the first connector 32. The second connector 58 has a second support 60, a third tongue 62, a fourth tongue 64 opposite the third tongue 62, and a second hinge 66. In the illustrative embodiment shown in FIG. 20, the second connector 58 has a second bracket 68 extending upwards from the second support 60 that serves as a handle.

Figure 20:
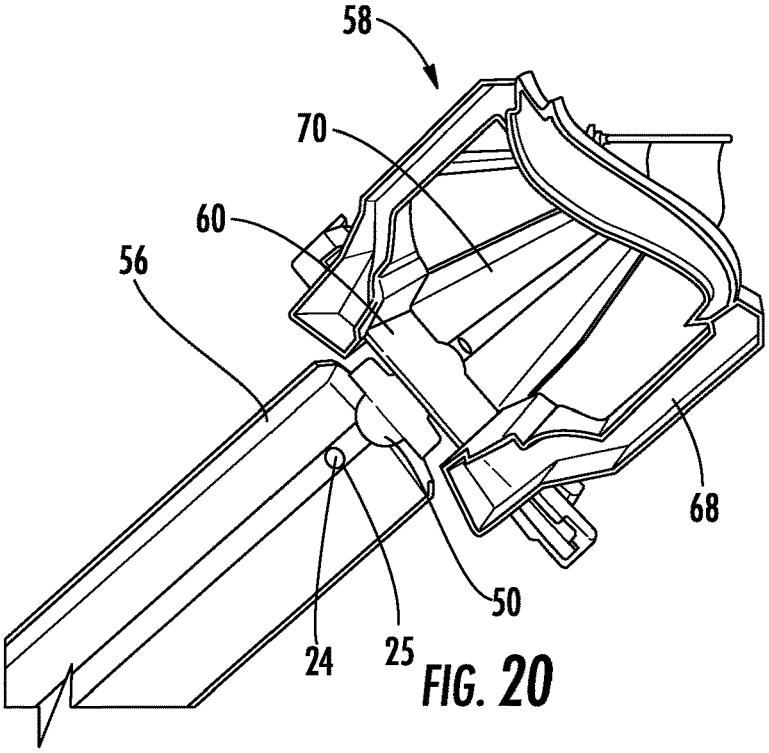
FIG. 20 is a perspective view of the second connector in the toy vehicle track set, in accordance with some embodiments.

FIG. 19 is a bottom view of the second connector 58, in accordance with some embodiments. FIG. 20 is a perspective view of the second connector 58 in the toy vehicle track set 10 with two track segments attached, in accordance with some embodiments. A fourth track segment 70 is hingedly coupled to the third track segment 56 by the second connector 58. The third tongue 62 and the fourth tongue 64 of the second connector 58 are configured to slidably couple to the third track segment 56 and the fourth track segment 70, respectively. The third tongue 62 and the fourth tongue 64 each includes a respective lip 50, and the third track segment 56 and the fourth track segment 70 each includes a respective button 24 to help guide and confirm the coupling. The third tongue 62 and the fourth tongue 64 of the second connector 58 are also configured to rotate relative to the second hinge 66 independently from one another.

FIG. 21 is a side view of the second connector 58, in accordance with some embodiments. As shown, the fourth track segment 70 is hingedly coupled to the third track segment 56 by the second connector 58. In this embodiment, the third tongue 62 of the second connector 58 is coupled to the third track segment 56, and the fourth tongue 64 of the second connector 58 is coupled to the fourth track segment 70. The third track segment 56 and the fourth track segment 70 are hingedly coupled via the second connector 58 and freely rotate downwards to approximately 90° relative to the second support 60.

Similar to the description of the rotation of the first tongue 36 and the second tongue 38, the third tongue 62 (or the third track segment 56 when coupled to the third tongue 62) and the fourth tongue 64 (or the fourth track segment 70 when coupled to the fourth tongue 64) are configured in some embodiments to rotate to approximately the same angle at the same time (as shown in FIG. 21) or to different angles at the same time in other embodiments. In other words, when the first tongue 36 and the second tongue 38 of the first connector 32 are coupled to the first track segment 22 and the second track segment 48, respectively, the first track segment 22 and the second track segment 48 independently rotate approximately 90° relative to the first connector 32, and each of the third track segment 56 and the fourth track segment 70 independently rotates approximately 90° relative to the second connector 58.

Referring to FIG. 1, the first track segment 22, the second track segment 48, the third track segment 56, the fourth track segment 70 and the loop track segment 30 are positioned to form a continuous path for a toy vehicle. In this way, when a toy vehicle is loaded into the toy vehicle launcher 52 and launched, the toy vehicle travels on the second track segment 48, the first track segment 22, the loop track segment 30, the third track segment 56, and then the fourth track segment 70 without stopping and without additional user input.

Figure 22:
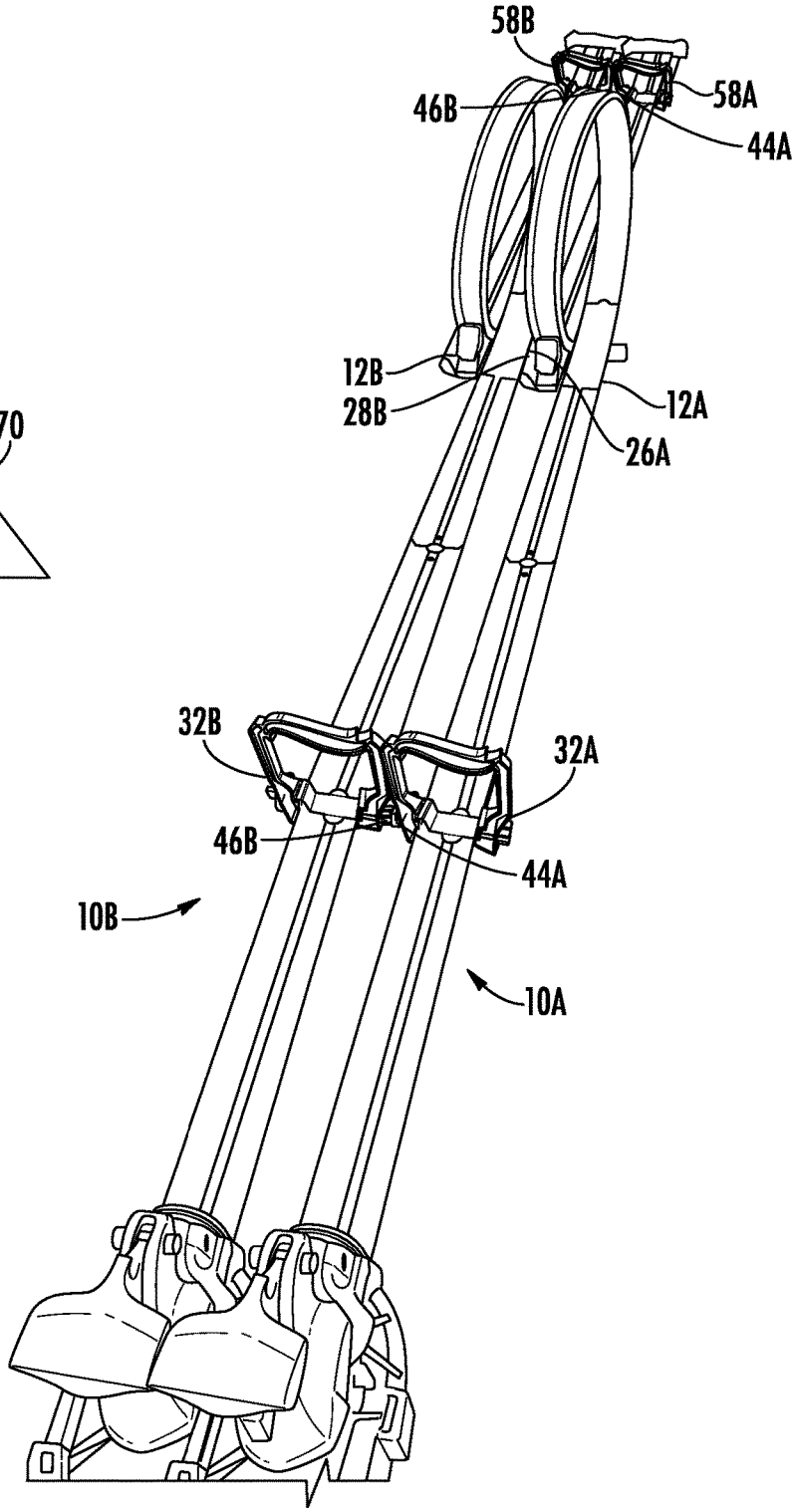
FIG. 22 shows two toy vehicle track sets coupled together, in accordance with some embodiments.

FIG. 22 shows two toy vehicle track sets or raceways coupled together, in accordance with some embodiments. In this illustrative embodiment, two toy vehicle track sets (or two toy vehicle raceways), 10A and 10B, are coupled together side-by-side by engaging the projection 44A of the first connector 32A of the first toy vehicle track set 10A with the socket 46B of the first connector 32B of an adjacent, second toy vehicle track set 10B, by engaging the projection 44A of the second connector 58A of the first toy vehicle track set 10A with the socket 46B of the second connector 58B of the adjacent, second toy vehicle track set 10B, and by engaging the joiner 26A of the base 12A of the first toy vehicle track set 10A with the slot 28B of the base 12B of the adjacent, second toy vehicle track set 10B. The connector between the projection 44A and the socket 46B is similar to FIG. 13, and the connector between the joiner 26A and slot 28B is similar to FIGS. 8 and 9.

Figure 23:
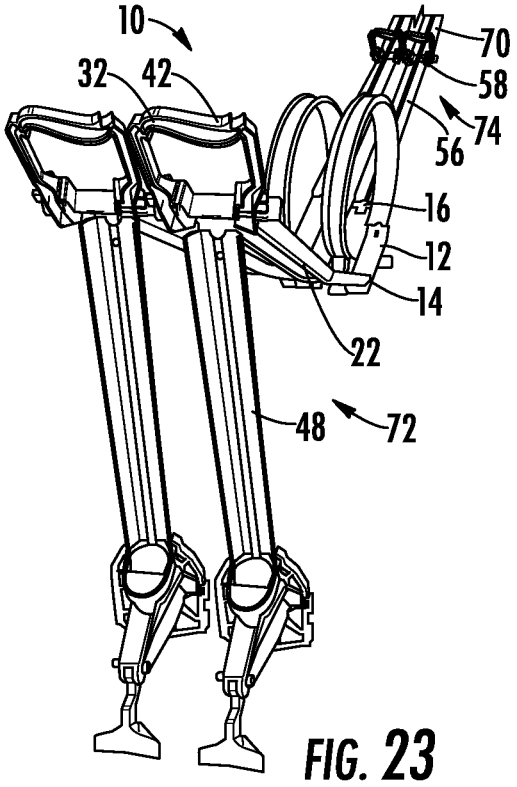
FIG. 23 shows two toy vehicle track sets coupled together while being folded, in accordance with some embodiments.

FIG. 23 shows two toy vehicle track sets 10 coupled together while being folded, in accordance with some embodiments. For each toy vehicle track set 10, a first foldable track 72 includes the first track segment 22, the first connector 32, and the second track segment 48. The first foldable track 72 is slidably coupled to the first tab 18 of the first pivotable end 14 of the base 12 (refer to FIGS. 2 and 7). A second foldable track 74 includes the third track segment 56, the second connector 58 and the fourth track segment 70. This coupling to the base 12 that has pivotable tabs 18 and 20 enables the first foldable track 72 to be pivoted substantially perpendicular to the base 12 and enables the second foldable track 74 to be pivoted substantially perpendicular to the base 12. Each toy vehicle track set 10 is constructed so that the first foldable track 72, the loop track segment 30, and the second foldable track 74 are positioned to form a continuous path for a toy vehicle to travel upon. To transform the toy vehicle track set into its more compact form, a force (e.g., a user lifting up the bracket from a play surface) is applied in the upward direction to the first bracket 42 of the first connector 32 causing the first track segment 22 and the second track segment 48 to rotate relative to the first connector 32 via the first hinge 40. In other words, the first foldable track 72 folds at the first connector 32 when the assembly is lifted. This is demonstrated in FIGS. 18 and 23. Likewise, a force is also applied in the upward direction to the second bracket 68 of the second connector 58 causing the third track segment 56 and the fourth track segment 70 to rotate relative to the second connector 58 via the second hinge 66. In other words, the second foldable track 74 folds at the second connector 58. This is shown in FIGS. 20-21. In the illustrative embodiment shown in FIG. 23, lifting the first connector 32 or second connector 58 of one raceway causes the other coupled raceway to also fold accordingly.

Figure 24:
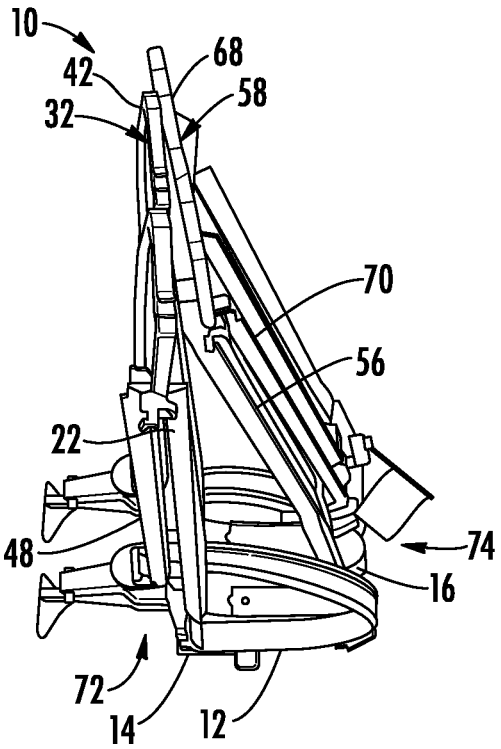
FIG. 24 shows two toy vehicle track sets coupled together in the folded position, in accordance with some embodiments.

FIG. 24 shows the two toy vehicle track sets 10 of FIG. 23 coupled together while in the folded position, in accordance with some embodiments. For each toy vehicle track set 10, the first foldable track 72 folds at the first connector 32 such that the first track segment 22 of the first foldable track 72 and the second track segment 48 of the first foldable track 72 are substantially adjacent to one another when the first foldable track 72 is pivoted substantially perpendicular to the base 12. The second foldable track 74 folds at the second connector 58 such that the third track segment 56 of the second foldable track 74 and the fourth track segment 70 of the second foldable track 74 are substantially adjacent to one another when the second foldable track 74 is pivoted substantially perpendicular to the base 12.

For each of the two toy vehicle track sets 10, the first bracket 42 of the first foldable track 72 and the second bracket 68 of the second foldable track 74 are positioned substantially adjacent to one another when the first foldable track 72 and the second foldable track 74 are pivoted substantially perpendicular to the base 12 and the first foldable track 72 and the second foldable track 74 are folded. Moreover, the first track segment 22 and the second track segment 48 rotate relative to the first connector 32 to a folded configuration substantially adjacent to one another when the first track segment 22 is pivoted substantially perpendicular to the base 12. The third track segment 56 and the fourth track segment 70 rotate relative to the second connector 56 to a folded configuration substantially adjacent to one another when the third track segment 56 is pivoted substantially perpendicular to the base 12.

The toy vehicle track set 10 may be quickly and easily set up for creative play or folded for storage without having to spend time or energy on reassembling, reorganizing or handling separate components. For example, to use the toy vehicle track set 10, the toy vehicle track set 10 is unfolded to an expanded configuration or flat position and ready to use. No assembly or tools are needed and no components are added or subtracted in order to use. When play is completed, the toy vehicle track set 10 is quickly and easily folded to a collapsed configuration for storage without disassembling any of the components from the toy vehicle track set 10. This includes embodiments where two or more toy vehicle track sets 10 or raceways are coupled together as described herein. The user may simply pull up on the first bracket 42 and the second bracket 68, and the first foldable track 72 and the second foldable track 74 naturally collapse or fold and lay adjacent to one another. This enables the folded toy vehicle track set 10 to have a much smaller footprint than when in the unfolded, flat position which requires a much greater space for storage.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only, and is not intended to limit the invention.

The invention claimed is:

1. A toy vehicle track set, comprising:

a base having a first pivotable end and a second pivotable end opposite the first pivotable end;

a first track segment coupled to the first pivotable end;

a first connector having a first hinge, a first tongue and a second tongue opposite the first tongue;

a second track segment hingedly coupled to the first track segment by the first connector;

a third track segment coupled to the second pivotable end;

a second connector having a second hinge, a third tongue and a fourth tongue opposite the third tongue;

a fourth track segment hingedly coupled to the third track segment by the second connector;

wherein the first tongue and the second tongue of the first connector are configured to slidably couple to the first and second track segments, respectively, and rotate relative to the first hinge; and wherein the third tongue and the fourth tongue of the second connector are configured to slidably couple to the third and fourth track segments, respectively, and rotate relative to the second hinge.

2. The toy vehicle track set of claim 1, wherein each of the first track segment and the second track segment independently rotates approximately 90° relative to the first connector, and each of the third track segment and the fourth track segment independently rotates approximately 90° relative to the second connector.

3. The toy vehicle track set of claim 1, wherein the first pivotable end comprises a first tab configured to slidably couple to the first track segment by engaging with an underside of the first track segment and enables the first track segment to be pivoted substantially perpendicular to the base, and the second pivotable end comprises a second tab configured to slidably couple to the third track segment by engaging with an underside of the third track segment and enables the third track segment to be pivoted substantially perpendicular to the base.

4. The toy vehicle track set of claim 1, wherein the first connector comprises a first support and a first bracket extending upward from the first support, and the second connector comprises a second support and a second bracket extending upward from the second support of the second connector.

5. The toy vehicle track set of claim 1, wherein each of the first connector and the second connector includes a projection located on a first side and a socket located on a second side opposite the projection.

6. The toy vehicle track set of claim 5, wherein two toy vehicle track sets are coupled together side-by-side by engaging the projection of one toy vehicle track set with the socket of an adjacent toy vehicle track set.

7. The toy vehicle track set of claim 1, further comprising a loop track segment located between the first pivotable end and the second pivotable end of the base.

8. The toy vehicle track set of claim 7, wherein the first track segment, the second track segment, the third track segment, the fourth track segment and the loop track segment are positioned to form a continuous path for a toy vehicle.

9. The toy vehicle track set of claim 1, wherein the first track segment and the second track segment rotate relative to the first connector to a folded configuration substantially adjacent to one another when the first track segment is pivoted substantially perpendicular to the base, and the third track segment and the fourth track segment rotate relative to the second connector to a folded configuration substantially adjacent to one another when the third track segment is pivoted substantially perpendicular to the base.

10. A toy vehicle track set, comprising:

a first toy vehicle raceway and a second toy vehicle raceway coupled together side-by-side, each raceway comprising:

a base having a first end, a second end opposite the first end, and a loop track segment between the first end and the second end;

a first foldable track pivotably coupled to the first end of the base;

a second foldable track pivotably coupled to the second end of the base; and a projection on one side of the raceway and a socket on an opposite side of the raceway;

wherein each of the first and second foldable tracks comprises a connector, a first track segment, and a second track segment hingedly coupled to the first track segment with the connector;

wherein the raceways are coupled together by engaging the projection of one raceway with the socket of an adjacent raceway.

11. The toy vehicle track set of claim 10, wherein each connector comprises a hinge, a first tongue and a second tongue opposite the first tongue, the first tongue and the second tongue are configured to slidably couple to the first track segment and the second track segment, and rotate relative to the hinge.

12. The toy vehicle track set of claim 10, wherein each of the first track segment and the second track segment independently rotates approximately 90° relative to the connector.

13. The toy vehicle track set of claim 10, wherein the first end includes a first pivotable tab configured to slidably couple with the first foldable track and enables the first foldable track to be pivoted substantially perpendicular to the base, and the second end includes a second pivotable tab configured to slidably couple with the second foldable track and enables the second foldable track to be pivoted substantially perpendicular to the base.

14. The toy vehicle track set of claim 13, wherein the first pivotable tab is configured to slidably couple with the first foldable track by engaging with an underside of the first foldable track, and the second pivotable tab is configured to couple with the second foldable track by engaging with an underside of the second foldable track.

15. The toy vehicle track set of claim 10, wherein the first foldable track folds at the connector such that the first track segment of the first foldable track and the second track segment of the first foldable track are substantially adjacent to one another when the first foldable track is pivoted substantially perpendicular to the base, and the second foldable track folds at the connector such that the first track segment of the second foldable track and the second track segment of the second foldable track are substantially adjacent to one another when the second foldable track is pivoted substantially perpendicular to the base.

16. The toy vehicle track set of claim 10, wherein each of the connector of the first foldable track and the connector of the second foldable track comprises a bracket extending vertically upward from a support, wherein the bracket of the first foldable track and the bracket of the second foldable track are positioned substantially adjacent to one another when the first foldable track and the second foldable track are pivoted substantially perpendicular to the base and the first foldable track and the second foldable track are folded.

17. A toy vehicle track set, comprising:

a base having a first pivotable end with a first tab and a second pivotable end with a second tab, the second pivotable end opposite the first pivotable end;

a first foldable track having a first track segment and a second track segment, the first foldable track slidably coupled to the first tab of the first pivotable end;

a second foldable track having a third track segment and a fourth track segment, the second foldable track slidably coupled to the second tab of the second pivotable end;

a first connector having a first hinge, a first tongue and a second tongue opposite the first tongue, the first tongue and the second tongue are configured to slidably couple to the first and second track segments, respectively, and rotate relative to the first hinge; and a second connector having a second hinge, a third tongue and a fourth tongue, the third tongue and the fourth tongue are configured to slidably couple to the third and fourth track segments, respectively, and rotate relative to the second hinge;

a projection on one side of the toy vehicle track set and a socket on an opposite side of the toy vehicle track set;

wherein two toy vehicle track sets are coupled together by engaging the projection of one toy vehicle track set with the socket of an adjacent toy vehicle track set.

18. The toy vehicle track set of claim 17, wherein the first connector comprises a first bracket extending vertically upward from a support of the first connector, and the second connector comprises a second bracket extending vertically upward from a support of the second connector.

19. The toy vehicle track set of claim 17, wherein the first pivotable end enables the first foldable track to be pivoted substantially perpendicular to the base and the second pivotable end enables the second foldable track to be pivoted substantially perpendicular to the base.

20. The toy vehicle track set of claim 18, wherein:

the first foldable track folds at the first connector when the first foldable track is pivoted substantially perpendicular to the base and the second foldable track folds at the second connector when the second foldable track is pivoted substantially perpendicular to the base; and the first bracket and the second bracket are positioned substantially adjacent to each other when the first and second foldable tracks are pivoted substantially perpendicular to the base and the first and second foldable tracks are folded.

* * * * *